United States Patent [19]

Pantaleo

[11] Patent Number: 4,536,926

[45] Date of Patent: Aug. 27, 1985

[54] SKI CLIP HOLDING DEVICE

[76] Inventor: Victor Pantaleo, 7854 Redondo La., Orland Park, Ill. 60462

[21] Appl. No.: 568,043

[22] Filed: Jan. 4, 1983

[51] Int. Cl.[3] ..... A44B 21/00; E05B 73/00

[52] U.S. Cl. ..... 24/523; 24/522; 24/331; 211/70.5

[58] Field of Search ..... 24/523, 331, 522, 524, 24/514, 490, 68 SK, 69 SK, 70 SK, 71 SK; 280/611; 248/316.6; 211/70.5

[56] References Cited

U.S. PATENT DOCUMENTS

| | | | |
|---|---|---|---|
| 1,516,489 | 11/1924 | Barton | 24/523 |
| 2,792,932 | 5/1957 | Freistat | 24/523 |
| 2,958,760 | 11/1960 | McNally | 24/523 |
| 3,379,018 | 4/1968 | Frentzel et al. | 24/523 |
| 3,509,882 | 5/1970 | Blake | 24/523 |
| 3,756,420 | 9/1973 | Brown | 211/70.5 |

FOREIGN PATENT DOCUMENTS

| | | | |
|---|---|---|---|
| 69246 | 5/1945 | Norway | 24/523 |
| 811954 | 4/1959 | United Kingdom | 24/523 |

*Primary Examiner*—Victor N. Sakran

*Attorney, Agent, or Firm*—Terry R. Mohr; Mathew R. P. Perrone, Jr.

[57] ABSTRACT

A ski clip to assist in the carrying of skis is formed by having a two-sectioned, generally "C-shape" for the ski clip, wherein the two sections are spring-loaded to hold the skis therein.

15 Claims, 2 Drawing Figures

SKI CLIP HOLDING DEVICE

BACKGROUND OF THE INVENTION

This invention relates to skis and more particularly to a device suitable for holding skis as a pair.

One of the most envigorating sports is skiing. Not only does skiing create pleasure for the participant, it is also good exercise.

There are, however, problems well-known to all skiers, which interfere with the pleasure of skiing. One particular problem is basically related to transporting the skis. The length of the skis renders them cumbersome and somewhat awkward to transport.

For carrying skis by hand, it is desirable to somehow temporarily hold the skis together as a pair. Many devices exist for this purpose. But all of the prior art devices suffer from one or more problems. A typical problem of a prior art device is that it is difficult to attach to the pair of skis. Alternatively, once attached, the device is difficult to remove from the pair of skis. Furthermore, a device may be too bulky and thereby increase the problem of carrying the skis. The ski holding device may also add too much weight to the pair of skis and complicate the ski transportation problem even further.

The length and bulkiness of skis also causes problems with vehicle transportation of skis. Sometimes skis are carried on the vehicle exterior. This exterior carry overcomes the bulkiness problem, but leads to a problem of having a secure fastening method to hold the skis thereon and overcome the force of air flow and other features which tend to pull the skis away from their bindings. If a suitable manner of holding the skis in pairs, these problems relating to transporting skis by a vehicle, can be overcome.

Thus an appropriate device for carrying skis must balance the contradictory features set forth above. It is clear that a device capable of being lightweight, relatively small, easy to apply and easy to remove while having holding strength when applied has a great advantage over the devices of the prior art.

SUMMARY OF THE INVENTION

Therefore, it is an object of this invention to provide a device for holding skis together temporarily.

A further object of this invention is to provide a device which is simple to attach to skis.

A still further object of this invention is to provide a device which can be simply removed from skis.

Yet a further object of this invention is to provide a device for holding skis which lacks bulkiness.

Also an object of this invention is to provide a lightweight device for carrying skis.

Another object of this invention is to provide a device which is strong enough to hold skis together for carrying.

Still another object of this invention is provide a device capable of assisting in the handcarrying of skis.

Yet another object of this invention is to provide a device which assists in the vehicle transport of skis.

These and other objects of this are met by a ski clip holding device having two sections held together and capable of being separated briefly for inserting skis therein.

DESCRIPTION OF THE PREFERRED EMBODIMENTS

A ski clamp for holding skis together during transport thereof is applied to the pair of skis, yet easily removable therefrom when it is desired to use the skis.

Figure 1:
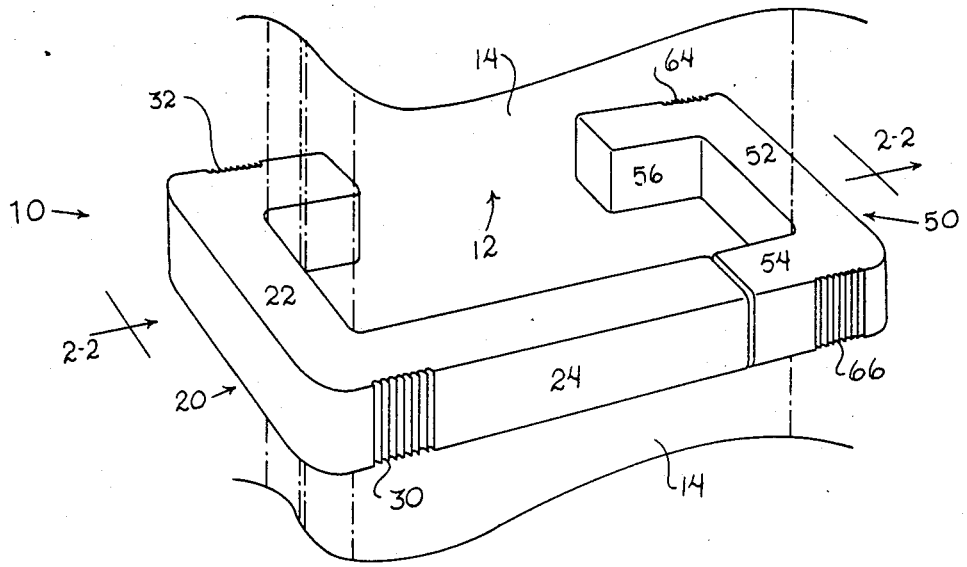
FIG. 1 is perspective view of the ski clip holding device 10 of this invention having a pair of skis 12 held therein.
Figure 2:
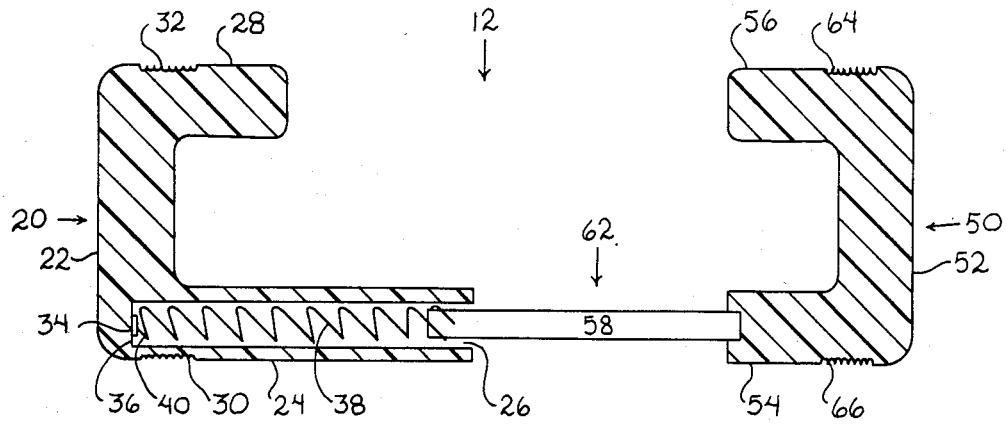
FIG. 2 is a cross-section of FIG. 1 along Line 2—2.

Referring now to FIG. 1 and FIG. 2, the ski clamp of this invention has an expandable insertion gap 12 for inserting skis 14 therein.

Ski clamp 10 includes hollow section 20 of a general J-shape. Hollow section 20 includes base 22, and trunk 24 perpendicular to base 22 at an end thereof. Trunk 24 forms the long side of the J-shape of hollow section 20. Within trunk 24 is trunk cavity 26 which renders trunk 24 a tubular member having closed end adjacent base 22 and an open end oppositely disposed therefrom. Trunk cavity 24 is the only hollow part of hollow section 20.

Completing the J-shape of hollow section 20 is forward leg 28 perpendicular to base 22 at the end oppositely disposed from trunk 24. Hollow section 20 has a generally square cross-section with rounded edges thereon for safety, gripping and aesthetic reasons. So while that generally square cross-section is preferred, other suitable shapes are operable—provided the appropriate gripping is available for operating ski clamp 10.

For the purpose of simplifying the application and removal of the ski clamp 10 from the skis, trunk 24 has a trunk grip 30 on the outer edge of trunk 24 adjacent base 22. Trunk grip 30 cooperates with edge grip 32 to provide opposite gripping points for removing or attaching ski clamp 10. Edge grip 32 is adjacent base 22 on the outer edge of forward leg 28.

Solid section 50 of ski clamp 10 is of a generally C-shape. Solid section 50 includes a top 52 having a rod support 54 perpendicular to one end thereof and adjacent trunk 24. Top leg 56 is perpendicular to top 52 at the other end thereof to thereby complete the generally C-shape of the solid section 50. The generally C-shape of solid section 50 combines with the J-shape of hollow section 20 to form an overall C-shape for ski clamp 10. Hollow section 20 has the same cross-section as solid section 50 for aesthetic reasons.

Referring now to FIG. 2, trunk cavity 26 has spring lock 34 at trunk base 36 for holding spring 38 therein at trunk end 40 of spring 38. Trunk base 36 is within trunk cavity 26 at the bottom thereof. Spring lock 34 is adapted to securely hold spring 38 within trunk cavity 26 in a clamping fashion or other suitable means.

Secured to rod support 54 is rod 58. Rod 58 is capable of sliding into trunk cavity 26. It is preferred that trunk cavity 26 not be circular in cross-section, and have some suitable non-circular cross-section. Such non-circular cross-sections include, but are not limited to, elliptical, rectangular, square, or polygonal shapes. In this fashion, hollow section 20 and solid section 50 cannot rotate relative to each other when rod 58 is in trunk cavity 26.

This lack of rotation is achieved by having rod 58 secured at one end in a standard fashion such as threaded, welded or other suitable means, to rod support 56. Rod 58 is shaped to mate in a male-female relationship with trunk cavity 26. While rod 58 is secured at one end to rod support 56, rod 58 is secured at the other end to spring 38 in standard fashion by rod connection 60. Rod connection 60 is formed by welding, gluing, insertion through an aperture (not shown) or other suitable means of securing rod 58 to spring 38. The strength of spring 38 and length of rod 58 are such that rod support 54 and trunk 24 abut when clamp 10 is in closed position 62 (FIG. 1).

Without skis therein, clamp 10 is held in closed position 62 by spring 38. With skis in clamp 10, clamp 10 may be partially open, so long as the skis are held. It is preferred for aesthetic reasons that the clamp 10 be closed with skis therein. Preferably, trunk 24 and rod support 54 are of sufficient length so that top 52 and base 22 abut the edge of skis 14 held in clamp 10. At the same time, trunk 24 and support 54 abut when clamp 10 is in closed position 60.

Forward leg 28 and top leg 56 are of sufficient length to provide insertion gap 12. Insertion gap 12 expands when ski clamp 10 is held open position 62 (FIG. 2), so the skis 14 may be inserted therein, and is sufficiently small when clamp 10 is in closed position 60 to hold skis 14 therein. Insertion gap 12 may expose 10 percent to 90 percent of the width of the skis. More preferrably, insertion gap 12 exposes 20 percent to 80 percent of the width of the skis. Most preferrably, insertion gap 12 exposes 30 percent to 70 percent of the width of the skis. In this fashion, skis 14 are properly held while being easily removable.

Base 22 and top 52 are of sufficient length to hold skis 14 in an abutting fashion with appropriate flat sides together.

On top support 54 is top grip 64. On rod support 56 is rod grip 66. Top grid 64, rod grip 66, trunk grip 30 and edge 32 cooperates to assist in opening ski clamp 10, by providing appropriate points for gripping to open ski clamp 10.

Ski clamp 10 is customarily used in pairs to hold skis in a proper position for carrying. Also ski clamp 10 may be used in combination with a vehicle carrier if desired.

In view of the disclosure herein, various modifications and changes can become apparent to a person having ordinary skill in this art. Such modifications and changes are clearly within the scope of this invention and any appended claims.

What is claimed and sought to be secured by Letters Patent of the United States is:

1. A generally large C-shaped ski clip for holding skis in pairs, said ski clip having a hollow section and a rod section joined together to form said generally large C-shaped clip, wherein:

(a) said hollow section is generally of a J-shape, said hollow section comprising a long, hollow arm of a generally square cross-section, a solid forward leg generally parallel to said long, hollow arm, a trunk connecting a first end of said long, hollow arm with a first end of said solid forward leg, said trunk being substantially perpendicular to said long, hollow arm and said solid forward leg;

(b) said rod section is generally of a small C-shape and combines with said J-shape to form said large C-shape;

(c) a rod is secured to one end of said rod section, and is slideably mounted and spring secured within said long hollow arm;

(d) said ski clip and said rod are of generally square cross-section; and (e) said rod and said hollow section made in a male-female relationship.

2. A generally large C-shaped ski clip for holding skis in pairs, said ski clip having a hollow section and a rod section joined together to form said generally large C-shaped clip, wherein:

(a) said hollow section is generally of a J-shape, said hollow section comprising a long, hollow arm of a generally non-circular cross-section, a solid forward leg generally parallel to said long, hollow arm, a trunk connecting a first end of said long, hollow arm with a first end of said solid forward leg, said trunk being substantially perpendicular to said long, hollow arm and said solid forward leg;

(b) said rod section is generally of a small C-shape and combines with said J-shape to form said large C-shape;

(c) a rod is secured to one end of said rod section, and is slideably mounted and spring secured within said long hollow arm;

(d) said ski clip is of a generally square cross-section; and (e) said rod and said hollow section mate in a male-female relationship.

3. The generally large C-shaped ski clip of claim 2 wherein said rod and said hollow arm have an elliptical cross-section.

4. The generally large C-shaped ski clip of claim 2 wherein said rod and said hollow arm have an polygonal cross-section.

5. The generally large C-shaped ski clip of claim 2 wherein said rod and said hollow arm have an rectangular cross-section.

6. The generally large C-shaped ski clip of claim 2 wherein said rod and said hollow arm have an elliptical cross-section.

7. The generally large C-shaped ski clip of claim 2 wherein said rod section includes a top leg oppositely disposed from and parallel to said rod; and an insertion gap is between said top leg and said forward leg.

8. The generally large C-shaped ski clip of claim 7 wherein said insertion gap is sufficiently small to hold a pair of skis in said ski clip.

9. The generally large C-shaped ski clip of claim 8 wherein said insertion gap exposes 10 percent to 90 percent of the width of said pair of skis.

10. The generally large C-shaped ski clip of claim 9 wherein said insertion gap exposes 20 percent to 80 percent of the width of said pair of skis.

11. The generally large C-shaped ski clip of claim 10 wherein said insertion gap exposes 30 percent to 70 percent of the width of said pair of skis.

12. The generally large C-shaped ski clip of claim 10 wherein said rod and said hollow arm have an elliptical cross-section.

13. The generally large C-shaped ski clip of claim 10 wherein said rod and said hollow arm have an polygonal cross-section.

14. The generally large C-shaped ski clip of claim 10 wherein said rod and said hollow arm have an rectangular cross-section.

15. The generally large C-shaped ski clip of claim 10 wherein said rod and said hollow arm have an elliptical cross-section.

* * * * *